US012553249B2

(12) United States Patent
Zeng et al.

(10) Patent No.: US 12,553,249 B2
(45) Date of Patent: Feb. 17, 2026

(54) SUPPORT FRAME AND FRAME POOL

(71) Applicant: BESTWAY INFLATABLES & MATERIAL CORP., Shanghai (CN)

(72) Inventors: Xianglin Zeng, Shanghai (CN); Xiaobo Chu, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 169 days.

(21) Appl. No.: 18/383,720

(22) Filed: Oct. 25, 2023

(65) Prior Publication Data

US 2024/0376733 A1 Nov. 14, 2024

(30) Foreign Application Priority Data

May 10, 2023 (CN) ..... 202321116975.1

(51) Int. Cl.
*E04H 4/00* (2006.01)

(52) U.S. Cl.
CPC ..... *E04H 4/0056* (2013.01)

(58) Field of Classification Search
CPC ..... E04H 4/0056
USPC ..... 4/506, 513, 584, 585
See application file for complete search history.

(56) References Cited

U.S. PATENT DOCUMENTS 3,553,744 A 1/1971 Gillen
4,303,226 A 12/1981 Powell et al.
5,548,852 A 8/1996 Rowe
6,071,213 A * 6/2000 Raasch ..... E04H 4/0056 4/506
11,459,781 B2 * 10/2022 Huang ..... E04H 4/0056
2003/0182722 A1 10/2003 Lee
2016/0215513 A1 * 7/2016 Liu ..... E04H 4/0056
2020/0282285 A1 * 9/2020 Colling ..... A63B 71/023

FOREIGN PATENT DOCUMENTS

CN 2930768 Y * 8/2007
CN 206342843 U * 7/2021
FR 1107334 12/1955
JP S4734212 12/1972
WO 2008019567 2/2008
WO WO-2022240299 A1 * 11/2022 ..... A63B 71/0054

OTHER PUBLICATIONS

Extended European Search Report dated May 8, 2024 (May 8, 2024), 8 pages, issued on related European Patent Application 23208755.1 by the European Patent Office.

* cited by examiner

*Primary Examiner* — Tuan N Nguyen
(74) *Attorney, Agent, or Firm* — Dickinson Wright PLLC

(57) ABSTRACT

A support frame for supporting a pool liner to form a frame pool is provided. The support frame includes: a first support assembly; and a second support assembly, wherein the first support assembly is detachably connected above and supported by the second support assembly. A frame pool is provided including a pool liner and the support frame. The pool liner includes: a first side wall supported by the first support assembly; and a second side wall supported by the second support assembly. The first side wall extends upwards in the vertical direction over an upper portion of the second side wall, and a lower edge of the first side wall is connected to at least part of the second side wall. The first side wall includes a transparent portion and the second side wall includes a non-transparent portion.

14 Claims, 6 Drawing Sheets

SUPPORT FRAME AND FRAME POOL

CROSS-REFERENCE TO RELATED APPLICATION

This Application claims priority from Chinese Application CN 202321116975.1, filed May 10, 2023 in China, the disclosure of which is incorporated herein by reference in its entirety.

BACKGROUND

1. Field

Example embodiments relate to pools, and in particular, to a support frame and a frame pool.

2. Description of Related Art

Many above-ground pools include a transparent portion, which is usually provided on a pool wall as a transparent window to enable visualization of the inside and outside of the pool.

Often, only a small area of the pool wall is made transparent, making it difficult to detect any abnormal conditions from the outside when children are playing in the pool, and causing a potential safety hazard. Furthermore, in existing pools, a region in the middle or above the middle of the pool wall is often cut out and replaced with a transparent material to form the transparent portion, which means that there are high material requirements and transparency requirements for the transparent portion and that it is inconvenient for the product to be folded.

SUMMARY

Example embodiments may address at least the above problems and/or disadvantages and other disadvantages not described above. Also, example embodiments are not required to overcome the disadvantages described above, and may not overcome any of the problems described above.

According to an aspect of an example embodiment, a support frame for an above ground pool comprises: a first support assembly; and a second support assembly, wherein the first support assembly is detachably connected above, and supported by, the second support assembly.

The first support assembly may comprise: a plurality of first vertical support members, each of the plurality of first vertical support members having a lower end connected above the second support assembly; a plurality of first horizontal support members; and a plurality of first T-joints, each of the plurality of first T-joints comprising: a first horizontal tubular portion having a first end and a second end, each connected to respective ones of the plurality of first horizontal support members, and a first vertical tubular portion perpendicular to the first horizontal tubular portion, the first vertical tubular portion connected to an upper end of one of the plurality of first vertical support members.

The second support assembly may comprise: a plurality of second horizontal support members; a plurality of second vertical support members; and a plurality of second T-joints, each of the plurality of second T-joints comprising: an upper connection portion detachably connected to the lower end of one of the plurality of first vertical support members, a second horizontal tubular portion having a first end and a second end, each connected to respective ones of the plurality of second horizontal support members, and a second vertical tubular portion perpendicular to the second horizontal tubular portion, the second vertical tubular portion connected to one of the plurality of second vertical support members.

The upper connection portion may be a slot, and the lower end of one of the plurality of first vertical support members may be inserted into the slot and thereby detachably connected to a corresponding one of the plurality of second T-joints.

The first support assembly may further comprise a plurality of fixing assemblies, each connected to a lower end of one of the plurality of first vertical support members: wherein the second support assembly may comprise: a plurality of second horizontal support members sequentially connected to each other, thereby forming an annular lower frame; and a plurality of ground support members connected and thereby supporting the plurality of second horizontal support members, the plurality of ground support members comprising one of a plurality of second vertical support members and a plurality of inclined support members, wherein each of the plurality of fixing assemblies is connected to and thereby supported by one of the plurality of second horizontal support members.

Each of the plurality of fixing assemblies may comprise: a base comprising: a receiving cavity configured to receive one of the plurality of second horizontal support members therein, the receiving cavity comprising a first inner wall having a through hole therethrough and a second inner wall; and a protrusion disposed on an upper portion of the receiving cavity, the protrusion extending upwards and having a fixing hole therethrough, wherein the lower end of one of the plurality of first vertical support members is inserted into the fixing hole.

Each of the plurality of fixing assemblies may further comprise: a screw extending through the through hole in the first inner wall, an end of the screw comprising a snap-fit portion; and an abutting member connected to the snap-fit portion and abutting against a side surface of the one of the plurality of second horizontal support members, such that the one of the plurality of second horizontal support members abuts between the first inner wall and the second inner wall.

The fixing assembly may further comprise: an adjusting nut disposed within a notch in the first inner wall, wherein the screw extends through the through hole and is threaded into the adjusting nut.

According to an aspect of another example embodiment, a frame pool, comprises: a support frame as described above; and a pool liner comprising: a first side wall supported by the first support assembly; and a second side wall supported by the second support assembly, wherein the first side wall extends over an upper portion of the second side wall, and a lower edge of the first side wall is connected to the second side wall.

The first side wall may comprise a transparent portion.

The first side wall may comprise a plurality of transparent portions and a plurality of non-transparent portions alternately arranged in a circumferential direction of the first side wall.

The second side wall may comprise a non-transparent portion.

BRIEF DESCRIPTION OF THE DRAWINGS

The above and/or other aspects will become apparent and more readily appreciated from the following description of example embodiments, taken in conjunction with the accompanying drawings, in which.

DETAILED DESCRIPTION

Figure 1:
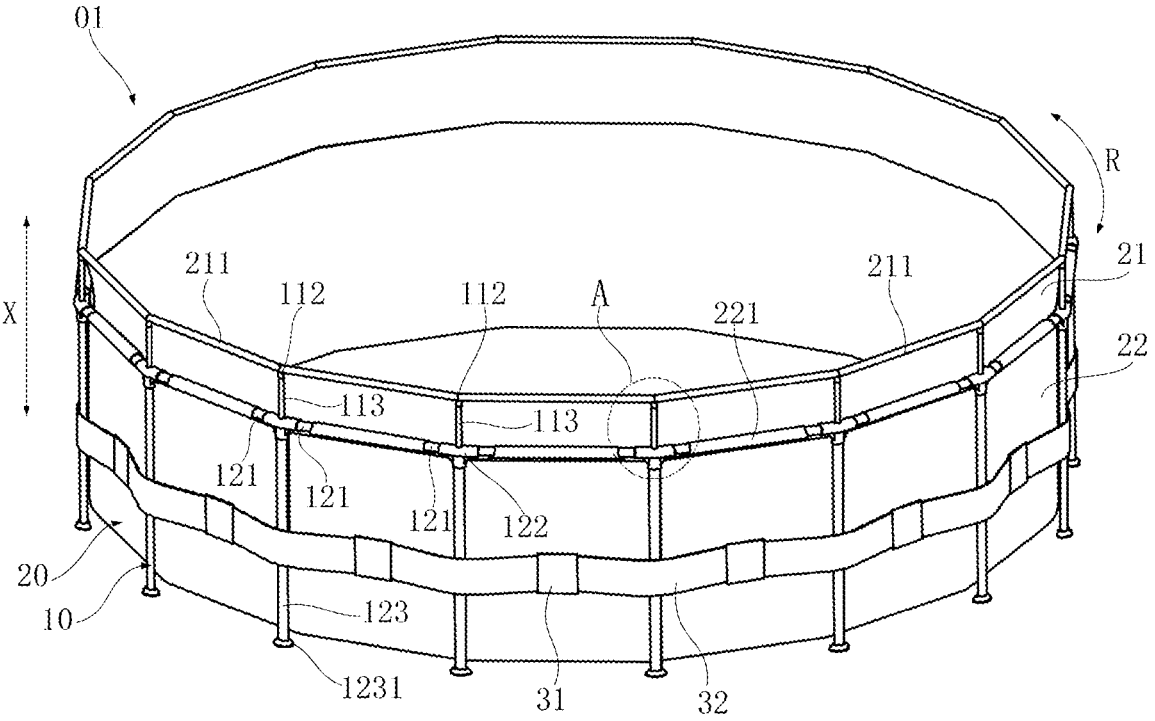
FIG. 1 shows a perspective view of a frame pool according to an example embodiment.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including", "comprise, and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

As used herein, the term "and/or" includes any and all combinations of one or more of the associated listed items. Expressions such as "at least one of," when preceding a list of elements, modify the entire list of elements and do not modify the individual elements of the list.

Various terms are used to refer to particular system components. Different companies may refer to a component by different names—this document does not intend to distinguish between components that differ in name but not function.

Matters of these example embodiments that are obvious to those of ordinary skill in the technical field to which these example embodiments pertain may not be described here in detail.

It should be noted that in the description, like reference signs and letters denote like items in the following drawings. Therefore, once an item is defined with respect to one of the drawings, it is not necessarily further defined and explained with respect to subsequent drawings.

Furthermore, although orientation or position relationships may be described using terms such as "upper", "lower", "inner" and "bottom," these terms are based on the orientation or position relationships shown in the drawings or the orientation or position relationships in which a product may be customarily placed during use, and are only intended to facilitate descriptions herein, rather than indicating or implying that the apparatus or element indicated must have a specific orientation or be configured and operated in the specific orientation.

It should also be noted that the terms "arrange," "connected," and "connection" should be understood in a broad sense, unless otherwise explicitly specified and limited. For example, a connection may be a fixed connection, a detachable connection, or an integral connection; or may be a mechanical connection or an electrical connection; and may be directly connected, or indirectly connected by means of an intermediate medium, or communication between interiors of two elements. For those of ordinary skill in the art, the specific meaning of the terms used herein should be understood in specific cases.

According to one or more example embodiments, a side wall of a frame pool includes two layers: an upper side wall and a lower side wall. The upper side wall includes a transparent portion, and the lower side wall includes a non-transparent portion. A support frame includes two layers: an upper support and a lower support. The upper side wall corresponds to the upper support, and the lower side wall corresponds to the lower support. That is, the upper side wall is supported by the upper support, and the lower side wall is supported by the lower support, such that the transparent portion is provided in the upper portion of the frame pool and may provide an extended field of view as compared to only a small transparent portion being provided in a pool wall.

Example embodiments of the structure of the pool will be described in detail below in combination with the accompanying drawings.

First Example Embodiment

Figure 2:
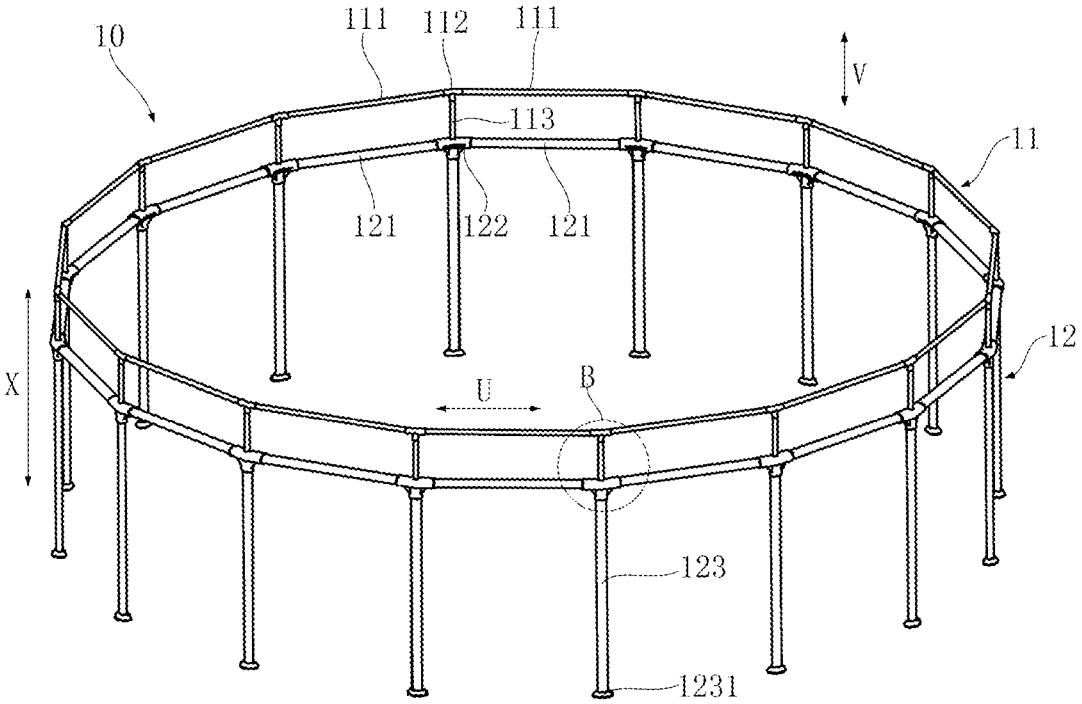
FIG. 2 shows a perspective view of a support frame according to an example embodiment.

Referring to FIGS. 1 and 2, this example embodiment includes a frame pool 01 including a support frame 10 and a pool liner 20, wherein the support frame 10 supports the pool liner 20 to form the circular frame pool 01 as shown in FIG. 1, and wherein the pool liner 20 can hold water therein.

Specifically, referring to FIG. 1, the pool liner 20 includes an upper side wall 21 and a lower side wall 22, wherein the upper side wall 21 includes a transparent portion (not shown). As an example, the transparent portion may extend in a circumferential direction R of the upper side wall 21 and may thus surround the pool liner 20, thus aiding in the observation of an inside of the frame pool 01 from the outside thereof, through the transparent portion of the upper side wall 21, and aiding in the reduction of potential safety hazards. The lower side wall 22 includes a non-transparent portion. That is to say, the lower side wall 22 may be provided with or without a transparent portion, and is not specifically limited in this example embodiment. For example, the lower side wall 22 may be provided without any transparent portion, and may be entirely opaque.

According to one or more example implementations, the entirety of the upper side wall 21 may be a transparent portion, that is, the entire upper side wall 21 is transparent in the circumferential direction of the upper side wall 21 (shown as a direction R in FIG. 1) to achieve the widest field of view.

According to one or more example implementations, the upper side wall 21 may include both a transparent portion and a non-transparent portion. The configuration of the transparent portion and the non-transparent portion is not limited. For example, a portion of the upper side wall 21 may be a transparent portion, and the remainder may be a non-transparent portion. Alternately, in the circumferential direction R, the upper side wall 21 may comprise alternately arranged transparent portions and non-transparent portions; that is, the transparent portions may be discrete and discontinuous. All of the above example implementations, as well as any other upper side wall 21 including any of a variety of other combinations of transparent and non-transparent portions, are applicable to any of the example embodiments described herein.

With further reference to FIG. 1, in a vertical direction (shown as a direction X in FIG. 1), a bottom end of the upper side wall 21 may be fixed to an upper portion of the lower side wall 22; that is, a lower edge of the upper side wall 21 may be connected to at least part of the lower side wall 22. Any method of fixing the upper side wall 21 to the lower side wall 22 may be used, as long as the structural strength and waterproof performance of the pool liner 20 can be ensured. As an example, the bottom end of the upper side wall 21 may be fixed to the upper portion of the lower side wall 22 by high-frequency welding. Any other fixing method that can meet the above requirements is applicable to any of the example embodiments described herein.

Referring to FIG. 2 in combination with FIG. 1, the support frame 10 includes an upper support assembly 11 and a lower support assembly 12. The lower support assembly 12 is configured to be supported on the ground, and the upper support assembly 11 is detachably disposed on an upper end of the lower support assembly 12 in the vertical direction X. Thus, the lower support assembly 12 may support the upper support assembly 11.

With further reference to FIG. 1 in combination with FIG. 2, the upper side wall 21 may correspond to the upper support assembly 11 in the vertical direction X, and the lower side wall 22 may correspond to the lower support assembly 12. The upper support assembly 11 is disposed on the upper portion of the lower support assembly 12 to support the upper side wall 21, and the lower support assembly 12 is supported on the ground to enable its support of the lower side wall 22. According to one or more example aspects, the independent upper support assembly 11 may support the upper side wall 21 having the transparent portion, and the upper side wall 21 may cover the upper support assembly 11, so that the area of the transparent portion may provide an expanded field of view. Moreover, as compared to a solution in which a region of the pool wall is removed to provide a transparent portion, one or more example embodiments described herein may have fewer requirements for the material of the transparent portion, may save cost, and may facilitate folding.

With further reference to FIG. 2, the upper support assembly 11 includes a plurality of first horizontal support members 111, a plurality of first T-joints 112, and a plurality of first vertical support members 113. As an example, each first horizontal support member 111 and each first vertical support member 113 may be a straight tube.

Figure 3:
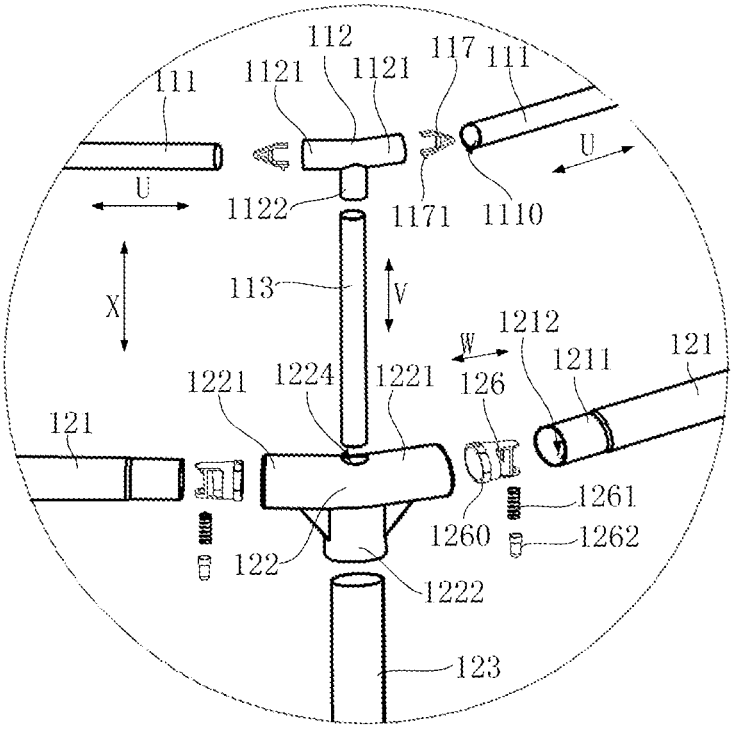
FIG. 3 shows an exploded view of part B of FIG. 2.

With reference to FIG. 3 and FIG. 2, each first T-joint 112 may include a first horizontal tubular portion 1121 and a first vertical tubular portion 1122, perpendicular to the first horizontal tubular portion; and opposite ends of the first horizontal tubular portion 1121 may be respectively connected to two adjacent first horizontal support members 111. Specifically, each of the ends of the first horizontal tubular portion 1121 is connected to an end of one first horizontal support member 111 in a length direction (shown as a direction U in FIG. 2), and another end of the one first horizontal support member 111 is connected to another first T-joint 112. The first vertical tubular portion 1122 of each first T-joint is connected to a first vertical support member 113. Specifically, each first vertical tubular portion 1122 is connected to an upper end of a first vertical support member 113 in a length direction (shown as a direction V in FIG. 2), and a lower end of each first vertical support member 113 is supported on the lower support assembly 12. An example method of connecting the lower end of the first vertical support member 113 to the lower support assembly 12 is described in detail below.

Referring to FIG. 2 and FIG. 3, by means of the first horizontal tubular portions 1121 of the plurality of first T-joints 112, adjacent ones of the plurality of first horizontal support members 111 are sequentially connected to each other, thereby forming a somewhat circular structure. As shown in FIG. 3, each first vertical support member 113 is connected to a first vertical tubular portion 1122 of a first T-joint 112.

Thus, according to this example embodiment, each first horizontal support member 111 is fixedly connected to a first horizontal tubular portion 1121 of a first T-joint 112 by means of a V-shaped elastic pin 117. A fixing protruding block 1171 is disposed at the V-shaped open end of each of the V-shaped elastic pins 117. Accordingly, the first horizontal support member 111 may be a hollow tube, and the tubular inner wall of each of the first horizontal support members 111 may be provided with a first connecting hole 1110. The first horizontal tubular portion 1121 of each first T-joint 112 may be a hollow tube, and the tubular inner wall of the first horizontal tubular portion 1121 of each first T-joint 112 may be provided with a connecting hole (not shown). Thus, upon connection of a first horizontal support member 111 to the horizontal tubular portion 1121 of a first T-joint 112, the connecting hole in the first horizontal tubular portion 1121 may align with the first connecting hole 1110, and the fixing protruding block 1171 of the V-shaped elastic pin 117 may pass through the connecting hole in the first horizontal tubular portion 1121 and the first connecting hole 1110, thereby fixing the first T-joint 112 to the first horizontal support member 111.

According to an example aspect, the mounting steps may be as follows. The V-shaped elastic pin 117 may be inserted into the first horizontal support member 111, and the V-shaped elastic pin 117 is thus pressed within the tube of the first horizontal support member 111 and then abuts against the inner tubular wall of the first horizontal support member 111 (not shown). When the fixing protruding block 1171 is moved to the position of the first connecting hole 1110, the fixing protruding block 1171 passes through the first connecting hole 1110 under an elastic action due to the elasticity of the V-shaped elastic pin 117.

The fixing protruding block 1171 may then be pressed so that the fixing protruding block 1171 retracts into the first connecting hole 1110, the first horizontal support member 111 may be inserted into the first horizontal tubular portion 1121 of the first T-joint 112, and the fixing protruding block 1171 may be made to abut against the tubular inner wall of the first horizontal tubular portion 1121 under the elastic action. When the fixing protruding block 1171 is moved to the position of the connecting hole in the first horizontal tubular portion 1121, the fixing protruding block 1171 passes through the connecting hole in the first horizontal tubular portion 1121 under the elastic action. In this way, the fixing protruding block 1171 passes through the first connecting hole 1110 and the connecting hole in the first horizontal tubular portion 1121, so that the first horizontal support member 111 is fixed to the first T-joint 112.

In this example aspect, the pressing of the fixing protruding block 1171 may refer to a user pressing the fixing protruding block 1171 with a finger so that the fixing protruding block 1171 is retracted into the first connecting hole 1110. Alternately, an end of the fixing protruding block 1171 that extends out of the first connecting hole 1110 may be a spherical surface (not shown), the first horizontal support member 111 may be inserted into the first horizontal tubular portion 1121, and a side surface of the tube wall of the first horizontal tubular portion 1121 may press the spherical end of the fixing protruding block 1171 so that the fixing protruding block 1171 is retracted into the first connecting hole 1110.

With further reference to FIG. 2, the lower support assembly 12 includes a plurality of second horizontal support members 121, a plurality of second T-joints 122, and a plurality of second vertical support members 123. Each second horizontal support member 121 and each second vertical support members 123 may be a straight tube.

Referring to FIG. 3, each second T-joint 122 includes a second horizontal tubular portion 1221 and a second vertical tubular portion 1222 perpendicular to each other. Opposite ends of the second horizontal tubular portion 1221 are each connected to a second horizontal support member 121, and the second vertical tubular portion 1222 is connected to a second vertical support member 123.

Specifically, referring to FIG. 3 and FIG. 2, the opposite ends of the second horizontal tubular portion 1221 are each connected to one end of a second horizontal support member 121 in the length direction (shown as the direction U in FIG. 2, the length direction of the second horizontal support member 121 is the same as the length direction of the first horizontal support member 111). The other end of the second horizontal support member 121 is connected to another second T-joint 122. The second vertical tubular portion 1222 of each second T-joint is connected to an upper end of a second vertical support member 123 in the length direction (shown as the direction V in FIG. 2, the length direction of the second vertical support member 123 is the same as the length direction of the first vertical support member 113), and a lower end of each second vertical support member 123 is supported on the ground.

Referring to FIG. 2 and FIG. 3, by means of the second horizontal tubular portions 1221 of the plurality of second T-joints 122, adjacent ones of the second horizontal support members 121 are sequentially connected to each other, thereby forming a somewhat circular upper frame analogous to the structure formed by the upper support assembly 11.

According to an example aspect, the method of connecting each of the second horizontal support members 121 to a second horizontal tubular portion 1221 may be the same as the above-described method by which each first horizontal tubular portion 1121 is connected to a first horizontal support member 111 (i.e., by means of the V-shaped elastic pin).

Alternately, the second horizontal support members 121 and the second horizontal tubular portions 1221 may be connected in another manner. As an example, referring to FIG. 3, each of the second horizontal support members 121 may be fixed to one of the second horizontal tubular portions 1221 by means of a fixing member 126. The fixing member 126 includes an annular outer wall 1260, an elastic member 1261, and a positioning pin 1262. The annular outer wall 1260 is located at a first end of the fixing member 126 in a length direction (shown as a direction W in FIG. 3), and the elastic member and the positioning pin 1262 are located at a second end of the fixing base 126 in the length direction W. As shown in FIG. 3, the elastic member 1261 in this example embodiment is a spring, but is not limited thereto. The elastic member may be any other of a variety of elastic members which would bias the positioning pin 1262 in a radially outward direction with respect to the annular outer wall 1260 of the fixing member.

With further reference to FIG. 3, the second horizontal tubular portion 1221 of the second T-joint 122 may be a hollow tube, and a fixing portion 1211 may be disposed at the end of the second horizontal support member 121 connected to the second horizontal tubular portion 1221. The fixing portion 1211 may be a hollow tubular element. The shape of the annular outer wall 1260 may match the shape of the inner wall of the second horizontal tubular portion 1221; that is, the annular outer wall 1260 may be fixed to the inner wall of the second horizontal tubular portion 1221 (not shown). The diameter of the fixing portion 1211 may be smaller than that of the remainder of the second horizontal support member 121. The inner wall of the fixing portion 1211 may be provided with a second connecting hole 1212, and the tube wall of the second horizontal tubular portion 1221 may also be provided with a connecting hole (not shown). The positioning pin 1262 fits with the second connecting hole 1212 and the connecting hole in the tube wall of the second horizontal tubular portion 1221 to thereby fix the second horizontal support member 121 to the second T-joint 122.

According to an example embodiment, a process of mounting the fixing member 126 may include inserting the positioning pin 1262 into the second horizontal tubular portion 1221 in a state in which the elastic member 1261 is pressed so that the annular outer wall 1260 is embedded in the tube wall of the second horizontal tubular portion 1221. When the positioning pin 1262 is aligned with the connecting hole of the tube wall of the second horizontal tubular portion 1221, the positioning pin 1262 extends into the connecting hole in the tube wall of the second horizontal tubular portion 1221 under the action of the elastic member 1261, so as to fix the fixing member 126 to the second horizontal tubular portion 1221.

The positioning pin 1262 may be pressed so that the positioning pin 1262 is retracted into the connecting hole in the tube wall of the second horizontal tubular portion 1221, and the second horizontal support member 121 may be inserted into the second horizontal tubular portion 1221 of the second T-joint 122, so that the positioning pin 1262 abuts against the tube wall of the fixing portion 1211 under the action of the elastic member 1261. When the positioning pin 1262 is aligned with the second connecting hole 1212, the positioning pin 1262 extends out of the second connecting hole 1212 under the action of the elastic member 1261 so that the second horizontal tubular portion 1221 is connected to the second horizontal support member 121.

In this example aspect, the pressing of the positioning pin 1262 may refer to pressing the positioning pin 1262 with a finger so that the positioning pin 1262 is retracted into the tube wall of the second horizontal tubular portion 1221. Alternately, an end of the positioning pin 1262 that extends out of the tube wall of the second horizontal tubular portion 1221 may be a spherical surface (not shown), the second horizontal support member 121 may be inserted into the second horizontal tubular portion 1221, and a side surface of the tube wall of the fixing portion 1211 of the second horizontal support member 121 may press the spherical end of the positioning pin 1262 so that the positioning pin 1262 is retracted into the connecting hole in the tube wall of the second horizontal tubular portion 1221.

According to another example aspect, the fixing member 126 may also be used in the connection between the first horizontal support member 111 and the first T-joint 112.

According to one or more example embodiments, the methods of connecting each first horizontal support member 111 to the first T-joint 112 and of connecting each second horizontal support member 121 to the second T-joint 122 are not limited to those specifically described above. Any of a variety of methods that can achieve stable connection between the first horizontal support member 111 and the first T-joint 112 and between the second horizontal support member 121 and the second T-joint 122 may be used in conjunction with any one or more of the example embodiments described herein.

According to an example embodiment, a method of connecting the lower end of the first vertical support member 113 to the lower support assembly 12 is described below.

Figure 4:
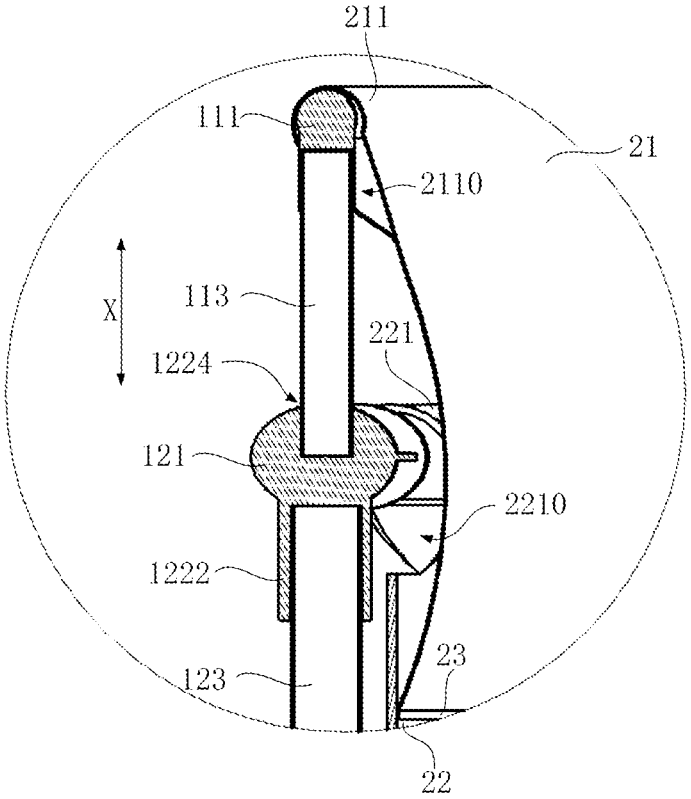
FIG. 4 shows a cross-sectional view of part A of FIG. 1.

Referring to FIG. 4 and FIGS. 3 and 2, the upper portion of each second T-joint 122 of the lower support assembly 12 is provided with a connection portion 1224, and the lower end of the first vertical support member 113 in the length direction V is connected to the second T-joint 122 by means of the connection portion 1224. Specifically, the connection portion 1224 may be a slot. The lower end of a first vertical support member 113 may be inserted into the slot in the vertical direction X so that the first vertical support member 113 is fixed to the second T-joint 122. Each first vertical support member 113 may be inserted into one slot, so that the upper support assembly 11 is connected to the lower support assembly 12 (as shown in FIG. 2).

Alternately, the upper portion of the second T-joint 122 may be provided with a protrusion (not shown) extending upwards in the vertical direction X, and the connection portion 1224 may be a slot disposed in the middle of the protrusion. The lower end of the first vertical support member 113 may be inserted into the slot in the vertical direction X so that the first vertical support member 113 is fixed to the second T-joint 122. Each first vertical support member 113 may be inserted into one slot, so that the upper support assembly 11 is connected to the lower support assembly 12.

Referring to FIG. 4 and FIGS. 1 and 2, the upper side wall 21 of the pool liner 2 has a first sleeving portion 211 and the lower side wall 22 has a second sleeving portion 221. The first sleeving portion 211 is sleeved over the first horizontal support members 111 so that the upper side wall 21 is connected to the upper support assembly 11, and the second sleeving portion 221 is sleeved over the second horizontal support members 121 so that the lower side wall 22 is connected to the lower support assembly 12.

In a state in which the first sleeving portion 211 is sleeved over the first horizontal support members 111 and the second sleeving portion 221 is sleeved over the second horizontal support members 121, the upper side wall 21 covers the upper support assembly 11 and a part of the lower support assembly 12, and the lower side wall 22 covers the lower support assembly 12 and does not cover the upper support assembly 11.

Specifically, the upper portion of the upper side wall 21 may be folded outwards to form the first sleeving portion 211; the first sleeving portion 211 has a first sleeving cavity 2110, and the first horizontal support member 111 is inserted into the first sleeving cavity 2110. Referring to FIG. 4 and FIG. 1, the first sleeving cavities 2110 may be discrete and discontinuous so that the plurality of first horizontal support members 111 may be inserted into breaks between adjacent ones of the first sleeving cavities 2110, so that the upper side wall 21 may be connected to the upper support assembly 11.

Similarly, the upper portion of the lower side wall 22 may be folded outwards to form the second sleeving portion 221; the second sleeving portion 221 has a second sleeving cavity 2210, and the second horizontal support member 121 is inserted into the second sleeving cavity 2210. Referring to FIG. 4 and FIG. 1, the second sleeving cavities 2210 may be discrete and discontinuous so that the plurality of the second horizontal support members 121 may be inserted into breaks between adjacent ones of the second sleeving cavities 2210, so that the lower side wall 22 is connected to the lower support assembly 12.

With further reference to FIG. 4, in this example embodiment, the upper side wall 21 may be fixed to the upper portion of the lower side wall 22 by means of high-frequency welding, and a pressing seam 23 is formed at the weld.

Referring again to FIG. 1, the frame pool 01 of this example embodiment further includes tensioning support devices 31 and a tensioning support band 32, the tensioning support devices 31 being connected to the outer surface of the pool liner 2. Specifically, each tensioning support device 31 may be disposed on the outer surface of the pool liner 2 between the two adjacent second vertical support members 123, and the tensioning support band 32 may pass through the tensioning support devices 31 in an overlapped manner. The tensioning support band 32 may extend around the second vertical support members 123 and may surround the outer surface of the frame pool 01, so that the second vertical support members 123 are attached to the outer surface of the frame pool 01 to increase the tensioning force of the pool liner 2. According to one or more example embodiments, the tensioning support band 32 may be arranged on the frame pool 01 at a height about ⅓ of the height of the frame pool 01, which may effectively reinforce the lower structure of the frame pool 01 to allow the frame pool 01 to have greater bearing capacity.

With reference to FIGS. 1 and 2, the frame pool 01 may further include a plurality of supporting bases 1231. Each of the supporting bases 1231 may be connected to a bottom end of a corresponding one of the second vertical support members 123 to improve the overall stability of the frame pool 01.

Second Example Embodiment

Figure 5:
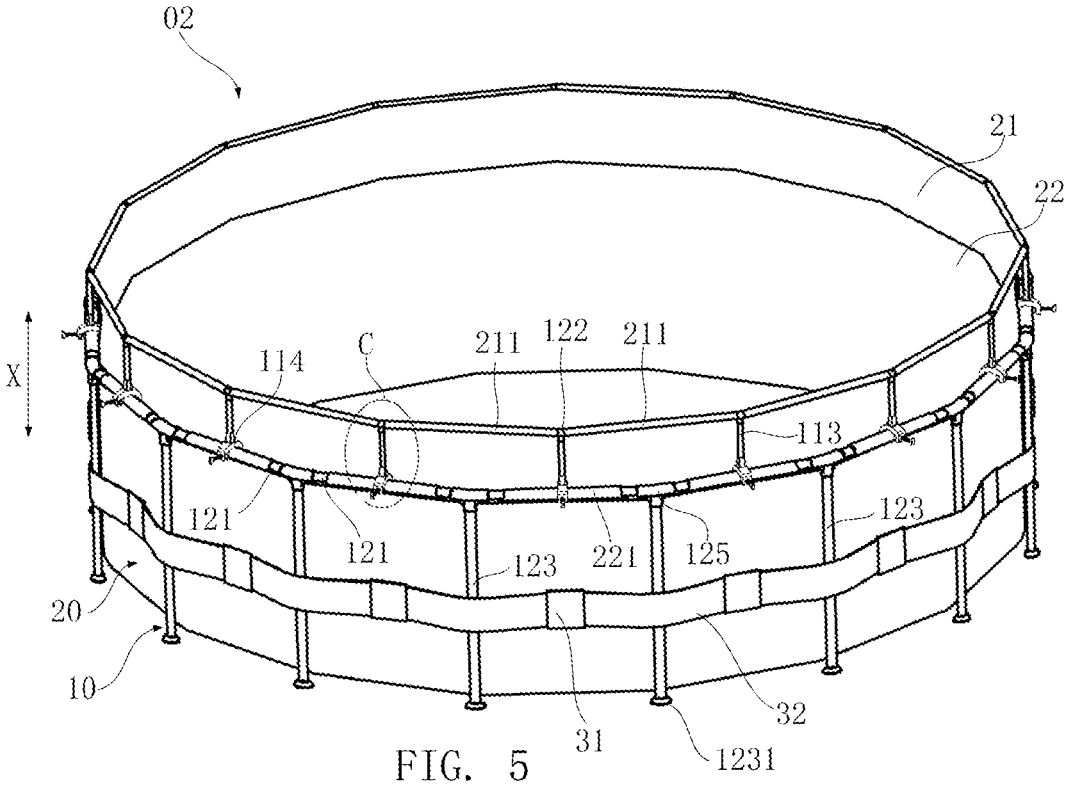
FIG. 5 shows a perspective view of a frame pool according to an example embodiment.
Figure 6:
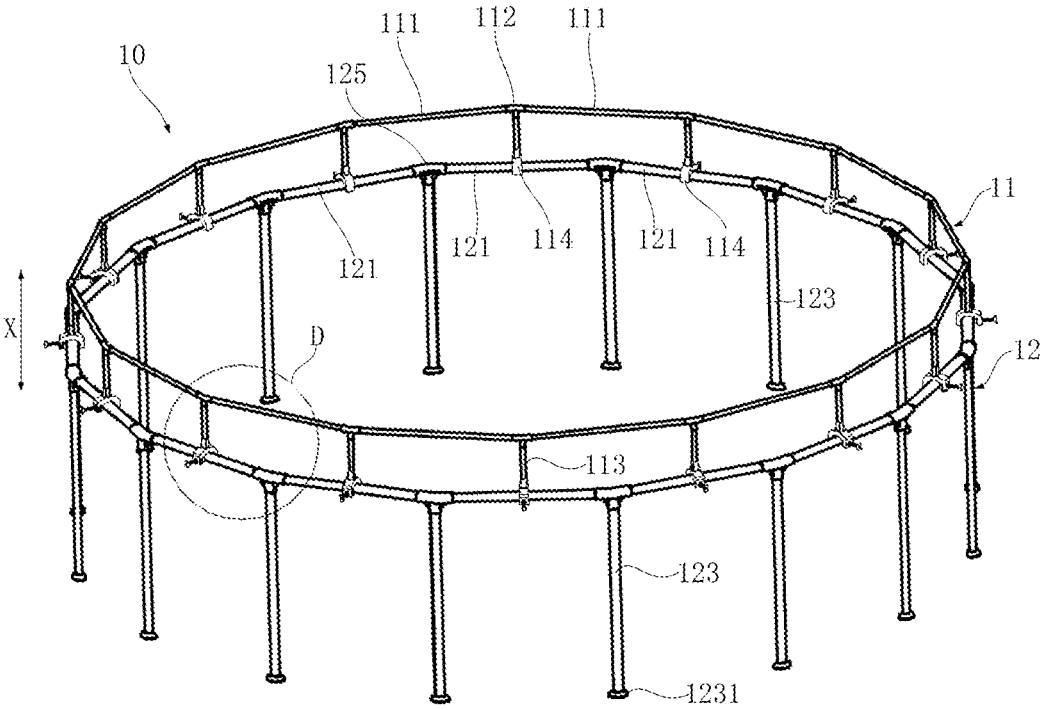
FIG. 6 shows a perspective view of a support frame 10 according to the example embodiment shown in FIG. 5.

The pool structure of this example embodiment is substantially the same as that of the first example embodiment. Referring to FIGS. 5 and 6, in this example embodiment, another frame pool 02 is provided. The difference between this example embodiment and the first example lies in that the upper support assembly 11 is connected to the lower support assembly 12 in a different manner.

Figure 7:
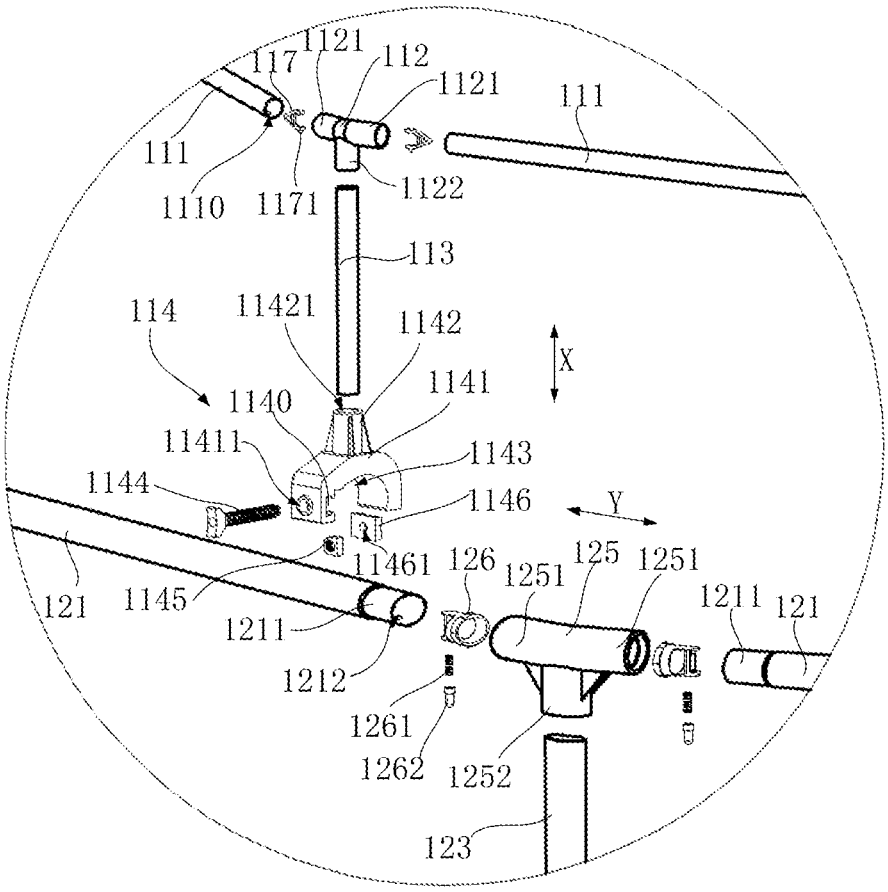
FIG. 7 shows an exploded view of part D of FIG. 6.

Specifically, referring to FIG. 7 and FIG. 6, each second T-joint 125 in this example embodiment is different from the second T-joints 122 of the first example embodiment (referring to FIG. 3). The upper portion of the second T-joint 122 of the lower support assembly 12 shown in FIG. 3 is provided with the connection portion 1224 (e.g., a slot). In contrast, the upper portion of each second T-joint 125 in this example embodiment shown in FIG. 7 is not provided with a connection portion. Accordingly, the method of connecting the first vertical support member 113 of the upper support assembly 11 to the lower support assembly 12 is changed. Referring to FIG. 6, in this example embodiment, the upper support assembly 11 is detachably fixed to the lower support assembly 12 by means of a plurality of fixing assemblies 114. Specifically, each vertical support member 113 of the upper support assembly 11 may be detachably fixed to one second horizontal support member 121 of the lower support assembly 12 by means of one fixing assembly 114.

As an example, referring to FIG. 7 and FIG. 6, a specific implementation of the fixing assembly 114 in this example embodiment is illustrated in FIG. 7. The fixing assembly 114 includes a base 1141, the upper portion of which is provided with a protrusion 1142. The protrusion 1142 extends upwards in a vertical direction X, and the protrusion 1142 is provided with a fixing hole 11421. A lower end of the first vertical support member 113 is inserted into the fixing hole 11421 in the vertical direction X so that the first vertical support member 113 is connected to the fixing assembly 114. That is, the upper support assembly 11 is connected to the fixing assembly 114.

With further reference to FIG. 7 and FIG. 6, a lower portion of the base 1141 is provided with a receiving cavity 1143, and the second horizontal support member 121 is inserted into the receiving cavity 1143 in an extension direction of the receiving cavity 1143 (shown as a direction Y in FIG. 7), so that the fixing assembly 114 is connected to the second horizontal support member 121. That is, the lower support assembly 12 is connected to the fixing assembly 114. By means of the connection between the fixing hole 11421 and the first vertical support member 113 and the connection between the receiving cavity 1143 and the second horizontal support member 121, the upper support assembly 11 is connected to the lower support assembly 12.

Figure 8:
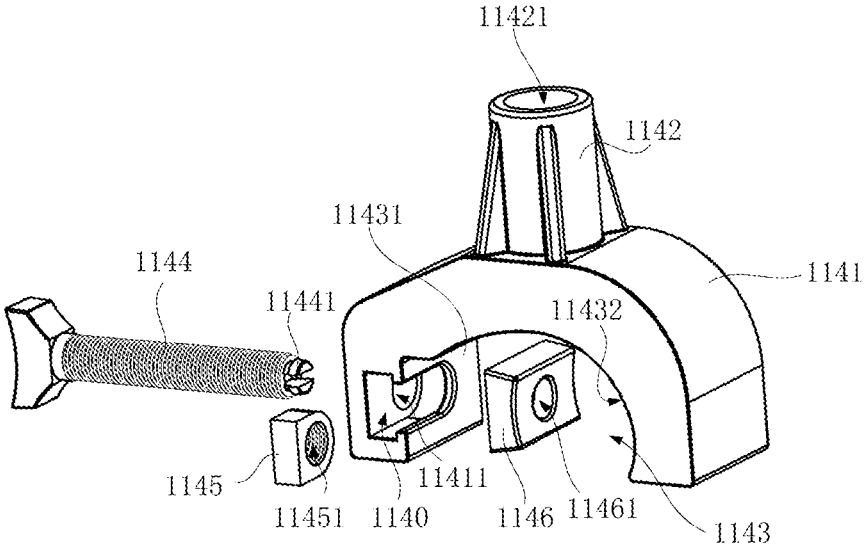
FIG. 8 shows an exploded view of a fixing assembly according to an example embodiment.
Figure 9:
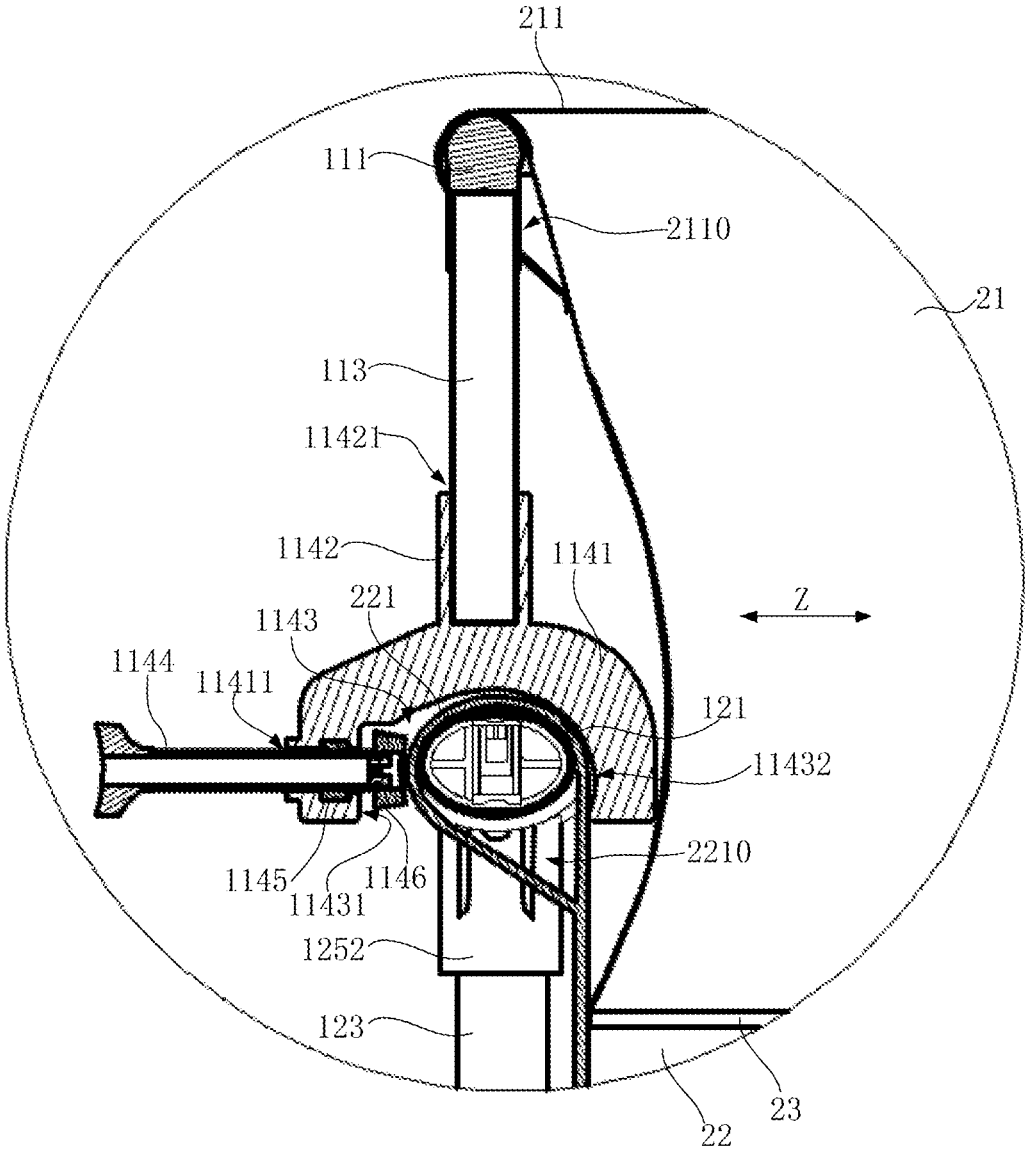
FIG. 9 shows a cross-sectional view of part C of FIG. 5.

With further reference to FIG. 7 and FIG. 8, in this example embodiment, the fixing assembly 114 further includes a screw 1144. Accordingly, the receiving cavity 1143 has a first inner wall 11431 and a second inner wall 11432, and the first inner wall 11431 is provided with a through hole 11411. The screw 1144 is inserted into the through hole 11411 and fixedly connected to the through hole 11411. One end of the screw 1144 extends into the receiving cavity 1143 through the through hole 11411 and abuts against one side of the second horizontal support member 121 (as shown in FIG. 9). The other side of the second horizontal support member 121 abuts against the second inner wall 11432. That is to say, one end of the screw 1144 abuts against a side surface of the second horizontal support member 121 to hold the second horizontal support member 121 between the first inner wall 11431 and the second inner wall 11432. The second horizontal support member 121 is clamped to the second inner wall 11432 in a horizontal direction by means of the screw 1144 (shown as the direction Z in FIG. 9).

With further reference to FIGS. 7, 8, and 9, the fixing assembly 114 further includes an abutting member 1146. The abutting member 1146 is fixed to the end of the screw 1144 that is located in the receiving cavity 1143, and is located between the first inner wall 11431 and the second horizontal support member 121. The abutting member 1146 is attached to one side of the second horizontal support member 121. Specifically, referring to FIG. 8 and FIG. 9, the side of the abutting member 1146 that faces the second horizontal support member 121 is a curved surface which has a shape corresponding to that of the side surface of the second horizontal support member 121. Thus, the abutting member 1146 may provide the screw 1144 with a fit with one side of the second horizontal support member 121, thereby enhancing the stability of connection between the fixing assembly 114 and the second horizontal support member 121.

According to one or more example implementations, with reference to FIGS. 7, 8, and 9, the fixing assembly 114 includes an adjusting nut 1145. The adjusting nut 1145 is threadable onto the screw 1144 to hold the screw 1144. Specifically, referring to FIG. 8, a notch 1140 is provided in the first inner wall 11431, and the adjusting nut 1145 is set into the notch 1140 from one side of the base 1141 and is thereby fixed to the base 1141. Referring to FIG. 9, the screw 1144 is inserted into the through hole 11411 from the outside of the base 1141 in the horizontal direction Z and is threaded into the adjusting nut 1145 so that the screw 1144 is fixed, and the screw 1144 extends out of the adjusting nut 1145 and then abuts against one side of the second horizontal support member 121. The adjusting nut 1145 can be removed from the notch 1140 and replaced. Accordingly, the base 1141 is adapted to various models of screw 1144, thus improving the versatility.

According to one or more alternate example implementations, the through hole 11411 may be provided with an internal thread (not shown), and the screw 1144 may be directly threaded into the internal thread of the through hole 11411, so that the screw 1144 is fixed to the base 1141 and extends into the receiving cavity 1143 through the through hole 11411 to abut against one side of the second horizontal support member 121.

With reference to FIG. 8 and FIG. 9, an end of the screw 1144 located in the receiving cavity 1143 may be provided with a snap-fit portion 11441, and the abutting member 1146 may be attached to the screw 1144 via the snap-fit portion 11441. Specifically, the abutting member 1146 may be provided with a snap-fit hole 11461, and the snap-fit portion 11441 may snap-fit with the snap-fit hole 11461 so that the abutting member 1146 is fixed to one end of the screw 1144.

Third Example Embodiment

Figure 10:
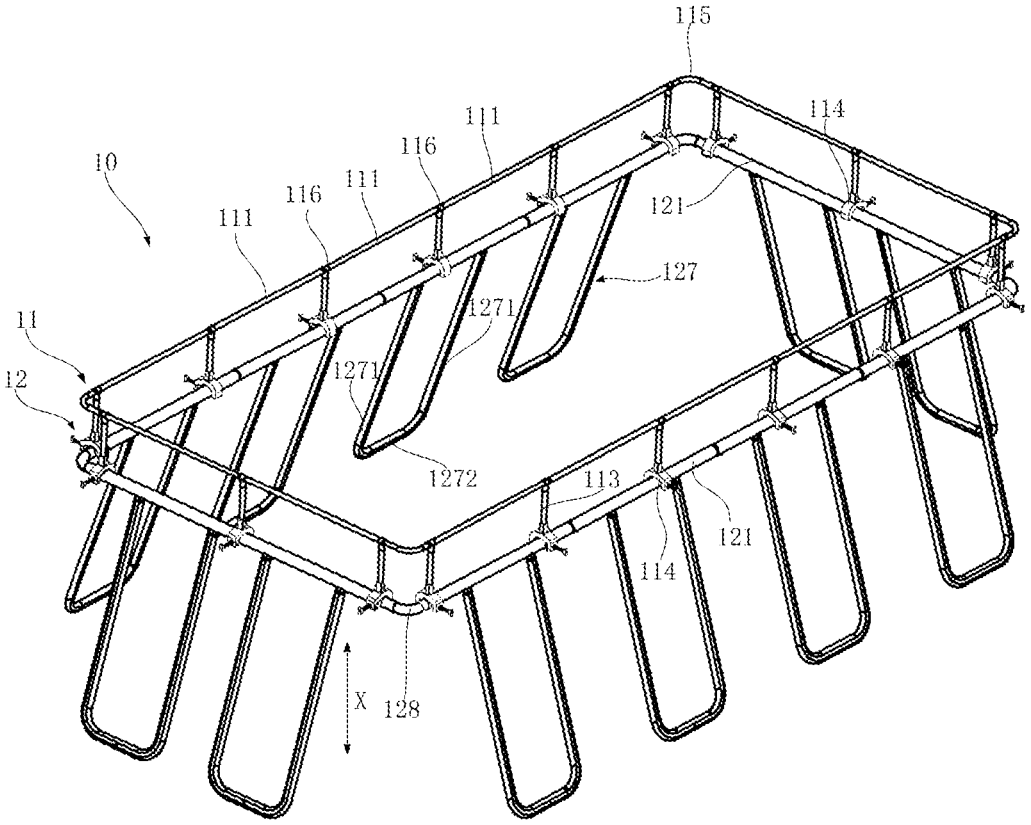
FIG. 10 shows a perspective view of a support frame according to another example embodiment.

This example embodiment provides another frame pool (not shown). Referring to FIG. 10, the difference between this example embodiment and the second example embodiment lies in that the specific shapes of the upper support assembly 11 and the lower support assembly 12 are different, and the frame pool in this example embodiment is in a substantially rectangular shape. The method of fixing between the upper support assembly 11 and the lower support assembly 12 may be the same. In addition, the frame pool in this example embodiment of the present application includes a pool liner (not shown in FIG. 10), which may have the same structure as the pool liner 20 of the first and second example embodiments.

The specific shapes of the upper support assembly 11 and the lower support assembly 12 of this example embodiment are specifically described below.

Referring to FIG. 10, according to this example embodiment, the lower support assembly 12 includes a plurality of second horizontal support members 121, a plurality of inclined support members 127, and four first connectors 128.

As an example, the plurality of second horizontal support members 121 may be sequentially connected to each other to form a substantially rectangular upper frame. Specifically, the first connectors 128 may each be L-shaped, and opposite ends of each first connector 128 are movably inserted into one of the plurality of second horizontal support members 121. The four first connectors 128 are connected to the plurality of second horizontal support members 121 that are connected to each other, so that the rectangular upper frame is formed. The four first connectors 128 are respectively arranged at four corners of the rectangular structure, that is, the first connectors 128 serve as right angles of the rectangular structure.

Each inclined support member 127 is fixed to the bottom of one second horizontal support member 121 to allow the plurality of second horizontal support members 121 to be supported on the ground.

As an example, with further reference to FIG. 10, one inclined support member 127 includes two vertical portions 1271 and one horizontal portion 1272. Together, the two vertical portions 1271 and the one horizontal portion 1272 form a U-shape. The U-shaped opening (i.e., the end of the two vertical portions 1271 away from the horizontal portion 1272) of each of the inclined support members 127 faces one of the plurality of second horizontal support members 121 and is fixed to the bottom of the corresponding one of the plurality of second horizontal support members 121. The horizontal portion 1272 of each of the plurality of inclined support members 127 is supported on the ground so as to allow the second horizontal support member 121 to be supported on the ground.

With further reference to FIG. 10, the upper support assembly 11 includes a plurality of first horizontal support members 111, a plurality of first vertical support members 113, a plurality of second connectors 115, and a plurality of first T-joints 116. The connections between the first horizontal support members 111, the first vertical support members 113, and the first T-joints 116 may be the same as those between the first horizontal support members 111, the first vertical support members 113, and the first T-joints 112, as described with respect to the first and second example embodiments, and a description thereof will not be repeated here. In addition, each first vertical support member 113 is also fixed to one second horizontal support member 121 by means of one fixing assembly 114.

Comparing this example embodiment with the first and second example embodiments, the first T-joint 116 is different as follows.

In the first and second example embodiments described herein, referring to FIG. 3, two first horizontal tubular portions 1121 of the first T-joint 112 are disposed at an angle, and accordingly, a substantially circular structure can be formed by connection of the plurality of first horizontal support members 111 to each other by means of the plurality of first T-joints 112.

In this example embodiment, referring to FIG. 10, the two horizontal tubular portions (not shown) of the first T-joint 116 are arranged linearly so that two adjacent first horizontal support members 111 connected by one first T-joint 116 form a straight structure, that is, form part of one side of a rectangular structure. Accordingly, the second connector 115 is L-shaped, and two ends of the second connector 115 are each movably inserted into one of the plurality of first horizontal support members 111 so as to form a right angle of the substantially rectangular structure. The four second connectors 115 are connected to the plurality of first horizontal support members 111 to form the substantially rectangular structure adapted to the lower support assembly 12.

When the rectangular upper support assembly 11 is fixed to the rectangular lower support assembly 12 by means of the plurality of fixing assemblies 114, the support frame 10 is substantially rectangular in shape; and when the support frame 10 is connected to the pool liner, the frame pool is substantially rectangular in shape.

Fourth Example Embodiment

Figure 11:
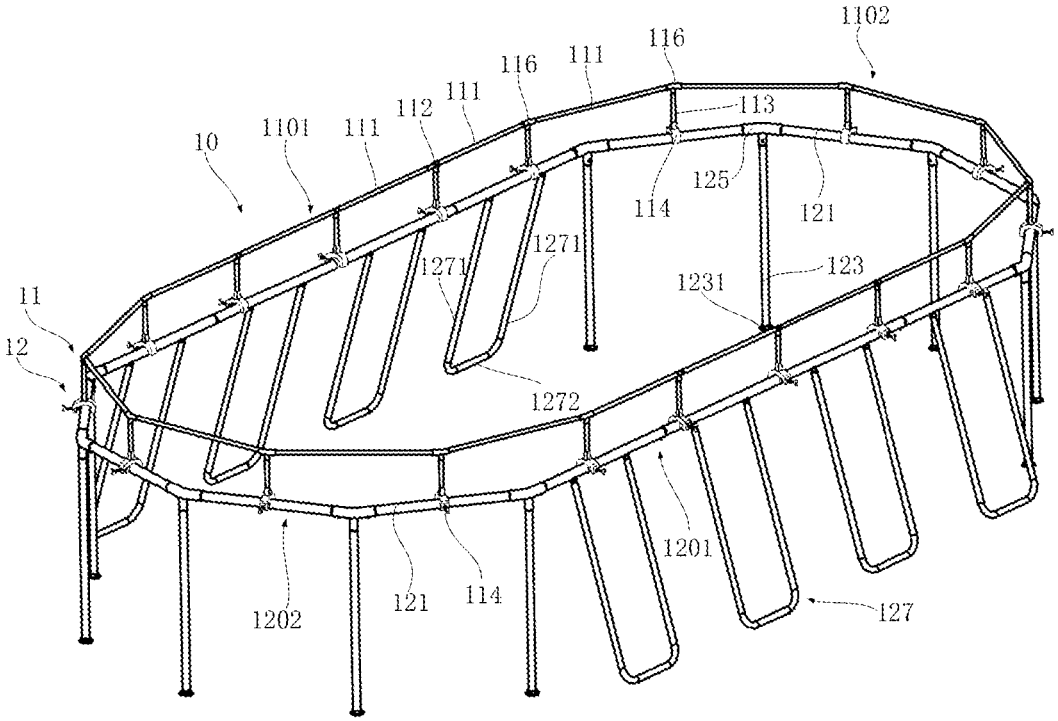
FIG. 11 shows a perspective view of a support frame according to still another example embodiment.

This example embodiment provides another frame pool (not shown). Referring to FIG. 11, the difference between this example embodiment and the second and third example embodiments lies in that the specific shapes of the upper support assembly 11 and the lower support assembly 12 are different, and the frame pool in this example embodiment is substantially elliptical in shape. The method of fixing between the upper support assembly 11 and the lower support assembly 12 may be the same. In addition, the frame pool in this example embodiment further includes a pool liner (not shown in FIG. 11). The pool liner of this example embodiment may have the same structure as the pool liner 20 of the first and second example embodiments.

The specific shapes of the upper support assembly 11 and the lower support assembly 12 of this example embodiment of are specifically described below.

Referring to FIG. 11, in this example embodiment, the lower support assembly 12 includes a plurality of second horizontal support members 121, a plurality of second T-joints 125, a plurality of second vertical support members 123, and a plurality of inclined support members 127. The second horizontal support members 121 and the second vertical support members 123 are the same as those described with respect to the second horizontal support members 121 and the second vertical support members 123 of the first and second example embodiments. With respect to this example embodiment, the second T-joints 125 and the inclined support members 127 are the same, respectively, as the second T-joints 125 and the inclined support members 127 described with respect to the third example embodiment, and the descriptions thereof will not be repeated.

In this example embodiment, the plurality of second horizontal support members 121 are sequentially connected to form a substantially elliptical shape. As shown in FIG. 11, the substantially elliptical shape includes two straight segments 1201 and two curved segments 1202.

As an example, in the part of the straight segment 1201, a plurality of second horizontal support members 121 are sequentially connected to each other in a straight line, and each inclined support member 127 is fixed to the bottom of one of the plurality of second horizontal support members 121. The structure of the straight segment 1201 is the same as the structure of the rectangular side of the rectangular structure of the lower support assembly 12 of the third example embodiment (as shown in FIG. 10).

As an example, the part of the curved segment 1202 is formed by connecting a plurality of second horizontal support members 121, a plurality of second vertical support members 123, and a plurality of second T-joints 125. The connections among these elements in this example embodiment are the same as those between the plurality of second horizontal support members 121, the plurality of second vertical support members 123, and the plurality of second T-joints 125 of the second example embodiment. The structure of the curved segment 1202 is the same as that of the lower support assembly 12 of the second example embodiment (as shown in FIG. 6).

With further reference to FIG. 11, the upper support assembly 11 includes a plurality of first horizontal support members 111, a plurality of first T-joints 112, a plurality of first vertical support members 113, and a plurality of first T-joints 116. The first horizontal support members 111 and the first vertical support members 113 of this example embodiment are the same those described with respect to the first, second, and third, example embodiments. The first T-joints 112 of this example embodiment are the same as those of the first and second example embodiments, and the first T-joints 116 of this example embodiment are the same as those of the third example embodiment.

Accordingly, the upper support assembly 11 is in the same substantially elliptical shape as the lower support assembly 12, and the substantially elliptical shape includes two straight segments 1101 and two curved segments 1102.

As an example, in a part of the straight segment 1101, a plurality of first horizontal support members 111 are sequentially connected to each other in a straight line. Specifically, two adjacent first horizontal support members 111 are connected to each other by means of one first T-joint 116, and each first vertical support members 113 is connected to one first T-joint 116. The connections between these elements are the same as those described with respect to the third example embodiment, and will not be repeated here. That is, the structure of the straight segment 1101 is the same as the rectangular side of the rectangular structure of the upper support assembly 11 of the third example embodiment (as shown in FIG. 10).

As an example, the part of the curved segment 1102 is formed by connecting a plurality of first horizontal support members 111, a plurality of first T-joints 112, and a plurality of first vertical support members 113. The connections between these elements are the same as those described with respect to the first and second example embodiments, and will not be repeated. That is, the curved segment 1102 has the same structure as the upper support assembly 11 of the second example embodiment (as shown in FIG. 6).

Each first vertical support member 113 is connected to one second horizontal support member 121 by means of one fixing assembly 114, so that a substantially elliptical support frame 10 is formed.

That is, when the elliptical upper support assembly 11 is fixed to the lower support assembly 12 by means of a plurality of fixing assemblies 114, the support frame 10 is in a substantially elliptical shape; and when the support frame 10 is connected to the pool liner, the frame pool is in a substantially elliptical shape.

It may be understood that the example embodiments described herein may be considered in a descriptive sense only and not for purposes of limitation. Descriptions of features or aspects within each example embodiment may be considered as available for other similar features or aspects in other example embodiments.

While example embodiments have been described with reference to the figures, it will be understood by those of ordinary skill in the art that various changes in form and details may be made therein without departing from the spirit and scope as defined by the following claims.

What is claimed is:

1. An above ground pool comprising:
- a support frame comprising:
  - a first support assembly; and
  - a second support assembly; and
- a pool liner comprising:
  - a first side wall extending between the first support assembly and the second support assembly; and
  - a second side wall extending downwardly from the second support assembly;
- wherein the first support assembly is detachably connected to and supported above the second support assembly; and
- wherein the first side wall includes a transparent portion extending in a circumferential direction about an entirety of the first side wall.

2. The above ground pool according to claim 1, wherein the first support assembly comprises:
- a plurality of first vertical support members, each of the plurality of first vertical support members having a lower end connected to the second support assembly;
- a plurality of first horizontal support members; and
- a plurality of first T-joints, each of the plurality of first T-joints comprising:
  - a first horizontal tubular portion having a first end and a second end, each end connected to respective ones of the plurality of first horizontal support members, and
  - a first vertical tubular portion perpendicular to the first horizontal tubular portion, the first vertical tubular portion connected to an upper end of one of the plurality of first vertical support members.

3. The above ground pool according to claim 2, wherein the second support assembly comprises:
- a plurality of second horizontal support members;
- a plurality of second vertical support members; and
- a plurality of second T-joints, each of the plurality of second T-joints comprising:
  - an upper connection portion detachably connected to the lower end of one of the plurality of first vertical support members,
  - a second horizontal tubular portion having a first end and a second end, each end connected to respective ones of the plurality of second horizontal support members, and
  - a second vertical tubular portion perpendicular to the second horizontal tubular portion, the second vertical tubular portion connected to one of the plurality of second vertical support members.

4. The above ground pool according to claim 3, wherein the upper connection portion comprises a slot, and the lower end of one of the plurality of first vertical support members is inserted into the slot and thereby detachably connected to a corresponding one of the plurality of second T-joints.

5. The above ground pool according to claim 2, wherein the first support assembly further comprises a plurality of fixing assemblies, each connected to the lower end of one of the plurality of first vertical support members;
- wherein the second support assembly comprises:
  - a plurality of second horizontal support members sequentially connected to each other to form an annular lower frame; and
  - a plurality of ground support members connected to and thereby supporting the plurality of second horizontal support members, the plurality of ground support members comprising at least one of a plurality of second vertical support members and a plurality of inclined support members,
- wherein each of the plurality of fixing assemblies is connected to and supported by one of the plurality of second horizontal support members.

6. The above ground pool according to claim 5, wherein each of the plurality of fixing assemblies comprises:
- a base comprising:
  - a receiving cavity configured to receive one of the plurality of second horizontal support members therein, the receiving cavity comprising a first inner wall having a through hole therethrough and a second inner wall; and a protrusion disposed on an upper portion of the receiving cavity, the protrusion extending upwardly and having a fixing hole therethrough, wherein the lower end of one of the plurality of first vertical support members is inserted into the fixing hole.

7. The above ground pool according to claim 6, wherein each of the plurality of fixing assemblies further comprises:

a screw extending through the through hole in the first inner wall and having an end comprising a snap-fit portion; and an abutting member connected to the snap-fit portion and abutting against a side surface of the one of the plurality of second horizontal support members, such that the one of the plurality of second horizontal support members is retained between the first inner wall and the second inner wall.

8. The above ground pool according to claim 7, wherein the fixing assembly further comprises:

an adjusting nut disposed within a notch in the first inner wall, wherein the screw extends through the through hole and is threaded into the adjusting nut.

9. The above ground pool of claim 1 wherein the second side wall comprises a non-transparent portion.

10. The above ground pool of claim 1, wherein the second side wall comprises a transparent portion extending in a circumferential direction about an entirety of the second side wall.

11. A frame pool, comprising:

a support frame comprising:

a first support assembly; and a second support assembly, wherein the first support assembly is detachably connected to and supported above the second support assembly; and a pool liner comprising:

a first side wall supported by the first support assembly; and a second side wall supported by the second support assembly, wherein the first side wall extends over an upper portion of the second side wall, and a lower edge of the first side wall is connected to the second side wall; and wherein the second side wall includes a transparent portion.

12. The frame pool according to claim 11, wherein the first side wall comprises a transparent portion extending in a circumferential direction about an entirety of the first side wall.

13. The frame pool according to claim 11, wherein the first side wall comprises a plurality of transparent portions and a plurality of non-transparent portions alternately arranged in a circumferential direction of the first side wall.

14. The frame pool according to claim 11, wherein the second side wall comprises a non-transparent portion.

* * * * *